US006248004B1

(12) United States Patent
Rooney, Sr.

(10) Patent No.: US 6,248,004 B1
(45) **Date of Patent: *Jun. 19, 2001**

(54) MULTIPHASE NUCLEATION REACTOR INJECTOR FOR HYDROBLAST CLEANING OF SURFACES

(76) Inventor: James J. Rooney, Sr., P.O. Box 77302, Houston, TX (US) 77215

( * ) Notice: Subject to any disclaimer, the term of this patent is extended or adjusted under 35 U.S.C. 154(b) by 0 days.

This patent is subject to a terminal disclaimer.

(21) Appl. No.: 08/815,628

(22) Filed: Mar. 13, 1997

(51) Int. Cl.[7] ..... B24C 9/00

(52) U.S. Cl. ..... 451/99; 423/349; 451/100; 451/446

(58) Field of Search ..... 423/349, 350; 451/38, 40, 99, 100, 446, 447

(56) References Cited

U.S. PATENT DOCUMENTS 4,642,227 * 2/1987 Flagan et al. ..... 423/349

5,375,378 12/1994 Rooney .

* cited by examiner

*Primary Examiner*—Timothy V. Eley
(74) *Attorney, Agent, or Firm*—Bracewell & Patterson L.L.P.

(57) ABSTRACT

This invention is related to the cleaning of surfaces using the hydroblasting technique, where the surface to be cleaned is exposed to a cleaning fluid mixture of liquid and abrasives which is ejected under high pressure. More particularly, this invention is related to hydroblasting apparatus and methods for providing abrasive hydroblasting cleaning fluid which do not require the direct pumping of the abrasive component of the mixture thereby greatly increasing the operating life of the high pressure hydroblasting pump. A single reactor technique is disclosed for making, and delivering under pressure, abrasive hydroblasting cleaning fluid made by nucleation of hydrolyzed solution. A multiple tube embodiment of the invention is also disclosed, as well as supplemental nucleation means and means for controlling the temperature of the nucleation process.

20 Claims, 4 Drawing Sheets

10
14
16
20
21
22
24
26
27
30
40
42
44
46
50
52
56
58
60
62
64
66
68
70
15

172
174

170
172
174

190
192

190
192

MULTIPHASE NUCLEATION REACTOR INJECTOR FOR HYDROBLAST CLEANING OF SURFACES

BACKGROUND OF THE INVENTION

1. Field of the Invention

This invention is related to the cleaning of surfaces using the hydroblasting technique where the surface to he cleaned is exposed to a cleaning fluid mixture of liquid and abrasives which is ejected under high pressure. More particularly this invention is related to hydroblasting apparatus and methods which do not require the direct pumping of the abrasive component of the cleaning fluid mixture thereby greatly increasing, the operating life of the high pressure hydroblasting pump.

2. Description of Ralated Art

Many techniques have been used to clean surfaces by exposing the surfaces to abrasives ejected under high pressure. The abrasive particles can be ejected directly upon the surface to he cleaned, or can be injected in a slurry or "carrier" liquid such as water or other suitable liquid.

Sandblasting has been used for a number of years as a method for cleaning certain types of surfaces. Sandblasting involves the ejection of sand particles at high pressure. These ejected particles impinge upon the surface to be cleaned and the abrasive properties of the sand clean the struck surface. Sandblasting involves the direct injection of the abrasive sand particles. No carries liquid is used. Sandblasting results in the accumulation of material in the vicinity of the cleaning operation which consists of material removed from the cleaned surface as well as the ejected sand particles. Sandblasting is, therefore, an appropriate cleaning method when the accumulation of material is not critical. As an example, sandblasting is an appropriate method for cleaning flat exterior surfaces where accumulated material can be easily removed. Sandblasting is not, however, an appropriate method for cleaning the interior of pipes, conduits, valves and other internal surfaces where the accumulation of material can further clog the apparatus being cleaned. In addition, sandblasting may often pit or otherwise damage the surface being cleaned.

Another technique employed for cleaning various surfaces is a technique generally referred to as "hydroblasting". Hydroblasting uses a liquid which is typically water and which is ejected under high pressure onto the surface to be cleaned. Hydroblasting is designed to clean many types of surfaces including interior surfaces. As an example, hydroblasting is often used to clean the interior of pipes and tubes in oil field equipment, in manufacturing operations, and in numerous additional applications. Hydroblasting essentially consists of the utilization of a pumping mechanism which causes the pressurized release, through an appropriate nozzle, of a stream of water.

Unfortunately, hydroblasters have generally proved to be ineffective in the cleaning of pipes which are clogged with viscous materials. Since the hydroblasting technique generally relics upon the rotation of the injector nozzle and relies upon the high pressure injection of water, it is common for hydroblasters to bog down in viscous materials within the pipe. Since the hydroblaster emits one stream of liquid for cleaning purposes, the clogging of the hydroblaster prevents the hydroblaster from properly rotating for the thorough cleaning of the pipe interior. As the hydroblaister encounters obstructions within the pipe, the high pressure stream of liquid emitted from the hydroblaster will only clean in one azimuthal direction within the pipe. This results in azimuthal sectors of the pipe interior from which the viscous material has not been cleaned. This partial cleaning of the pipe interior is often referred to as "streaking".

It has been found that the sticking of pipes in an ineffective solution to the problem of clogged pipes. Whenever streaking occurs in a pipe, this results in easier and quicker accumulation of clogging material. Stated another way, streaking promotes additional accumulation of material or "addition". Since the use of conventional hydroblasters almost always results in the streaking of the interior conduit surface, hydroblasting is a relatively ineffective means for cleaning pipes and tubes, especially if these conduits are clogged with viscous material.

In conventional hydroblasting applications, when the hydroblasting nozzle becomes clogged within the pipe, the operator of the hydroblaster typically increases the pressure from the nozzle until it effectively penetrates the viscous material in the pipe. Under these circumstances, there is no way to maintain constant rotation of the spinning nozzle. As a result, it has become conventional in hydroblasting to rely on pure water force for the cleaning of pipes and other surfaces. The use of high pressure results in increased fuel consumption by the pumping mechanism. It also causes an increase in fatigue of the blaster gunner. As increased fatigue is applied to all components of the hydroblasting apparatus, there is a corresponding increase in the chance of an accident resulting form component failure under high pressure. Given the high pressures that are utilized in any hydroblasting operation, any metal fatigue or other material deterioration can cause a potentially fatal accident. In order to avoid such fatigue and dangers, hydroblasting companies must greatly increase their costs of maintenance and inspection of equipment. Another problem associated with the use of extremely high pressures for the hydroblasting of surfaces is that higher pressures more frequently result in lower amounts of water ejected per unit time, or lower "blasting volumes". Reduction in blasting volume usually results in less waste product removal from the surface being cleaned.

U.S. Pat. No. 5,375,378 to James J. Rooney. which is assigned to the assignee of the present disclosure, discloses a solution which greatly improves the hydroblasting technique. The teachings of this patent are herein entered by reference. In summary, Rooney discloses apparatus and methods for cleaning a surface which utilize a hydrolyzed solution of preferably silica compound and water having solid particles of silica compound. The silica compound and the water are pumped, using separate pumps, to an orifice. The hydrolyzed solution is formed and ejected thought the orifice at a pressure greater than 500 pounds per square inch (psi) thereby impinging the solid particles of silica compound onto the surface to be cleaned. The abrasive action of tile solid particles clean the surface, and the water component continuously flushes abrasive particles and waste removed from the cleaned surface. The technique is suited for cleaning interior and exterior surfaces, and overcomes the previously discussed problems associated with conventional hydroblasting. As mentioned previously, the silica compound is delivered to the nozzle by means of a dedicated pump. The abrasive silica compound greatly reduces the operating life of this dedicated pump. Presently, there is no known high pressure pump that will effectively pump the silica compound for an extended operating period. This requires that the pump be service finds maintained at frequent intervals thereby significantly increasing the cost of the cleaning operation.

An object of the present invention is to provide apparatus and methods for cleaning interior and exterior surfaces using a high pressure pumping mechanism, wherein the apparatus requires minimal maintenance, and wherein a hydrolyzed solution is delivered at high pressure but does not pass thorough the pumping mechanism.

An additional object of the present invention is to provide a cleaning technique which, when used to cleaning interior surfaces such as pipes or tubes, does not cause streaking.

A further object of the present invention is to provide a hydroblasting method for cleaning which reduces effective pressure required for effective cleaning.

A still further object of the present invention is to provide a cleaning apparatus which is optimized for vertical orientation and can be modified for horizontal orientations and wherein portions of the apparatus can be shut down for maintenance or repair without terminating cleaning operations.

Another object of the present invention is to provide a method for cleaning which is environmentally sale.

A further objective of the present invention is to provide apparatus and methods for controlling the temperature of the solution being nucleated thereby preventing temperature related nucleation retardation.

There are other objects and applications of the present invention which will become apparent in the following disclosure and claims.

SUMMARY OF THE INVENTION

The present invention relates to apparatus and methods for cleaning both exterior and interior surfaces. Preferably, a hydrolyzed solution of a silica compound such as sodium silicate, which contains abrasive solid particles, is sprayed through an orifice under high pressure onto the surface to be cleaned. The term "hydrolyzed solution" will be defined in a subsequent section. The invention apparatus comprises a nucleation reactor chamber which contains the silica compound to be ejected under pressure. The term "nucleation" will be defined in a subsequent section. The silica compound can be placed within the reactor by a variety of methods including simply pouring. The density of the silica compound is greater than the density of water. The nucleation reactor also contains water which is pumped into the reactor under pressure, and which is partitioned from the hydrolyzed silica compound. Water pressure is transferred, through the water/silica compound partition to the silica compound within the nucleation reactor. The silica compound is subsequently forced, under pressure, from the nucleation reactor and through a suitable nozzle, and disclose in previously referenced U.S. Pat. No. 5,375.378, onto the surface to be cleaned. Using the apparatus and methods of the present invention, it is not necessary to pass the hydrolyzed silica compound through any pumping mechanism. Only water is pumped thereby greatly increasing the operating life of the high pressure pounding equipment.

In one embodiment of the invention, a mechanical partition is used to separate the more dense silica solution front the less dense water solution. The partition moves within the nucleation reactor vessel as hydrolyzed silica solution is forced out for "hydroblaster" cleaning, and water, under pressure, displaces the ejected silica compound. In another embodiment of the invention multiple nucleation reactor tubes, connected by a common water inlet manifold, are employed. The tubes are initially filled with the solution of silica compound. Water is pumped at a high pressure into the top of each tube thereby forcing the hydrolyzed silica solution out of the tube, under pressure, and to the hydroblasting nozzle. A baffle and capillary tube arrangement is used to "partition" the water from the silica solution, rather than a mechanical partition, as the solution is forced from the tube.

Both embodiments can be oriented to operate vertically or horizontally, although some venting must be modified as will be discussed in the detailed description of the preferred embodiments.

The present invention eliminates the need to pass the hydrolyzed solution of silica compound through a pump, as taught in previously referenced U.S. Pat. No. 5,375,378. This greatly extends the operating life of the pumping mechanism of the present invention. The present invention retains other advantages disclosed in the referenced patent. As an example, the methods of the present invention are generally compatible with conventional hydroblasting operations. As an additional example, the present invention provides cleaning techniques which do not streak the interior of tubular such as pipes. As a further example, the present system provides a method of cleaning, using hydroblasting technology, which is easy to use, relatively inexpensive, and very effective.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

DETAILED DESCRIPTION OF THE PREFERRED EMBODIMENTS

Before disclosing in detail the preferred embodiments of the invention, certain definitions used in the context of this disclosure will be set forth.

As disclosed herein, a "hydrolyzed solution" of a silica compound and water relates to a solution wherein the silica compound is a water soluble silica compound therein, or, wherein the solution is an aqueous solution. Additional information concerning hydrolyzed solutions is included in previously referenced U.S. Pat. No. 5,375,378, which has been incorporated by reference.

As disclosed in Introduction to Separation Science, Crystallization, by W. R. Wilcox, p. 303–335, edited by Barry L. Karler and Lloyd R. Snyder, published by John Wiley and Soins, 1973, hereby incorporated by reference, "nucleation" rates to the forming of the nucleus of a crystalline structure. The nucleus of a crystal is defined as a certain critical size. Sufficiently large to overcome the influence of surface energy, wherein the crystal grows spontaneously by addition of molecules from the solution. As disclosed herein, "nucleation" also refers to the forming of additional polymeric structures, including the fracturing of larger polymers into smaller polymers. Nucleation may be induced by providing a supersaturated or super cooled solution. Further, nucleation may be induced and increased (1) mechanically (dynamic nucleation) by friction, (2) by high speed fluid motion, (3) by cavitation, (4) by seed crystals, (5) by crystal breeding or secondary nucleation, by crystal fracturing, and (7) by contact nucleation. Temperature control of product prevents retardation in nucleation. In an embodiment of this invention a control chamber, in which the temperature of the chemical to be nucleated is regulated is used as an element in the nucleation process as will be discussed in subsequent sections of this disclosure. The effects of temperature in the nucleation process are discussed in The Kinematics of the Nucleation p. 101–103, by A. C. Zittlemeyer, Marcel Dekker, Inc., New York, 1969, and arc entered herein by reference.

It is believed that the methods presented in this disclosure may improve or increase the number of solid particles in the hydrolyzed solution to be sprayed at the surface to be cleaned, thereby improving the cleaning efficiency. Several of the recited means of nucleation are used in the percent invention, as will become apparent in the following disclosure.

Multiphase, Single Vessel Nucleation Reactor

Figure 1:
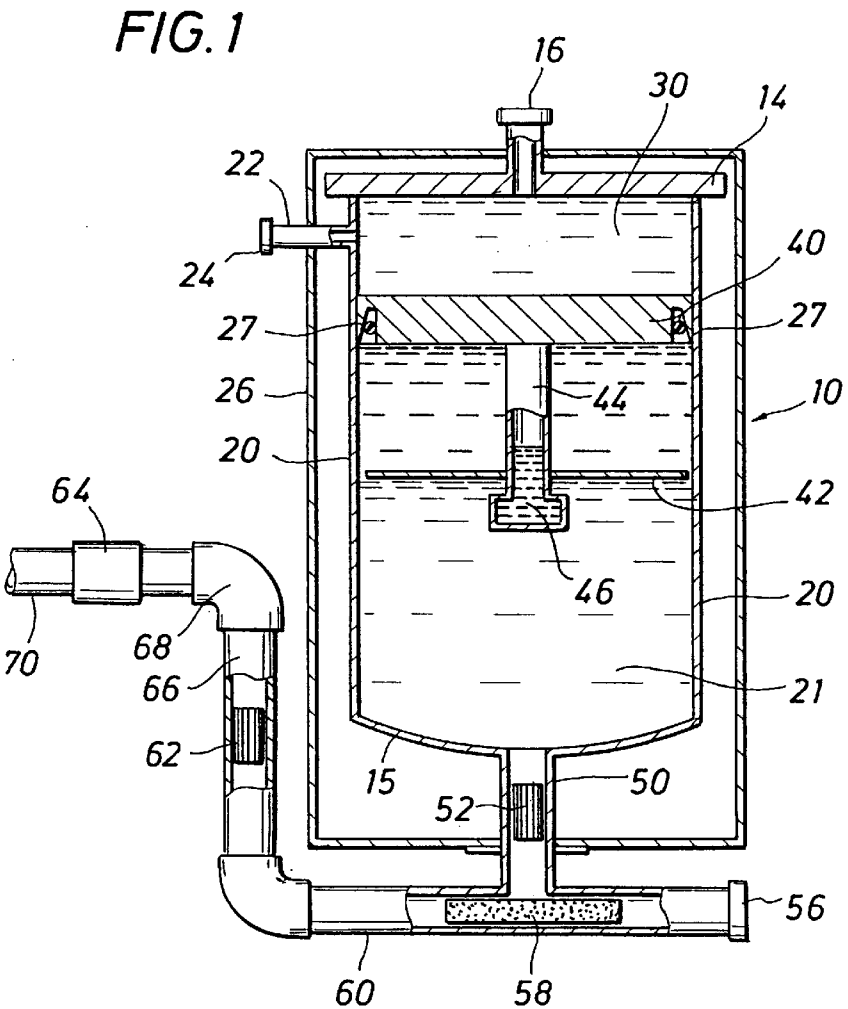
FIG. 1 is a side sectional view of a multitude, nucleation reactor.

FIG. 1 illustrates a side view of a multiphase, nucleation reactor, identified in general by the numeral 10. A single reactor vessel 20 is preferably enclosed in a protective shroud or case 26. The reactor vessel 20 is preferably cylindrical in shape and closed at the upper end with a top 14, and closed at the lower end with preferably a domed shaped plate 15. The lower part of the vessel 20 is filled with a hydrolyzed solution 21 preferably comprising a silica compound and water. The hydrolyzed solution 21 can be pumped into the vessel 20 through an alternate recharge inlet 56 which connects to a conduit 50 into the bottom of the vessel 20 at the dome plate 15. Alternately, hydrolyzed solution can initially be injected into the top of the vessel 20 by a vent and recharge port 16, or alternately can simply be poured into the vessel by removing the top 14 and pouring the solution 21. The density of the hydrolyzed solution 21 is greater than the density of water. Chemical and physical properties of the solution will he disclosed in a subsequent section.

Again referring to FIG. 1 the vessel 20 also contains water 30 which tends to "float" on top of the more dense hydrolyzed solution 21, A floating partition plate 40 is employed to further insure that the water 30 and hydrolyzed solution remain separate. Attached to the preferably disk shaped partition plate 40 is mercury tube 44 containing an amount of mercury 46 or other suitable material to ballast the partition plate so that it is more dense than the water 30, but less dense than the hydrolyzed solution 21. The disk shaped partition plate 40 incorporates a suitable circumferential seal assembly 27, which promotes a movable seal between the plate 40 and the wall of the cylindrical vessel 20. The partition plate and mercury tube assembly further comprises a guidance and solution mixing, retardation plate 42 which guides the motion of the partition plate 40 as it moves upward and downward with ally variation in the level of the hydrolyzed solution 2 1. The plate 42 also serves to prevent excess dilution of the hydrolyzed solution by any water that might leak around the peripheral seal 27 of the partition plate 4).

Referring again to FIG. 1, water is delivered to the vessel 20 by means of the conduit 22 and fitting 24 to which the output of a high pressure water pump (not shown) is attached. Operating water pump pressure is typically 20,000 psi. With the port 16 closed by a valve (not shown), the water column 30 exerts a large pressure on the partition plate 40 which, in turn, transfers this pressure to the column of hydrolyzed solution 21. The hydrolyzed solution is ejected, under high pressure, from the vessel 20 through the port 50 which preferably contains a catalytic impact tube cartridge 52 which contains impact planes and fins, The cartridge induces nucleation by means of several processes recited in a previous section thereby forming abrasive crystals within the flowing hydrolyzed solution. After passing through the catalytic impact cartridge 52, the hydrolyzed solution then flows through a fragmented glass catalytic impact tube cartridge 58 which further induces nucleation as described in the referenced U.S. Pat. No. 5.375.378. The hydrolyzed solution continues to flow, under high pressure through a conduit 60 and preferably through a catalytic fin impact tube cartridge 62 which further promotes nucleation. High pressure low of hydrolyzed solution containing nucleated abrasive particles continues through a conduit 66, through an elbow 68 and through an outlet 70 which connects to a hydroblaster gun (not shown). A check valve 64 prevents reactor drainage. The reactor 10 supplies a hydrolyzed solution containing nucleated abrasive particles, at a very high pressure, to any suitable hydroblasting apparatus such as apparatus disclosed in previously reference U.S. Pat. No. 5,375,378.

It should be understood that the reactor can he operated in a horizontal position as well as the depicted vertical position by simply relocating sonic of the vents and outlets for incompatibility with the hydroblasting equipment. Furthermore, in disclosing the operation of the reactor 10, it is apparent that it is not necessary to pump hydrolyze solution through a pumping mechanism in order to obtain the high pressure ejection of this solution for cleaning purposes. This is, as discussed previously, a distinct advantage over prior art systems in that pump operating life is not shortened by the action of abrasive particles contained in the nucleated, hydrolyzed solution.

Multiphase Multiple Tube Nucleation Reactor

The invention can be embodied so as to eliminate the use of a separation plate. This invention, which will he referred to as a multiple tube reaction, exhibits operational advantages is some situations, especially when the orientation of the reactor is varying In addition, one or more tubes can be taken out of service for maintenance or repair, and the remaining tubes call be used to keep the system operational.

Figures 2, 4B:
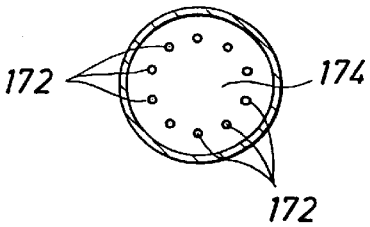
FIG. 2 is a side sectional view of a multitude, miltiphase nucleation reactor.
FIG. 4*b* illustrates top sectional views of an operating retardation cartridges used in the tubes of the multitude, miltiphase nucleation reactor.
Figure 3:
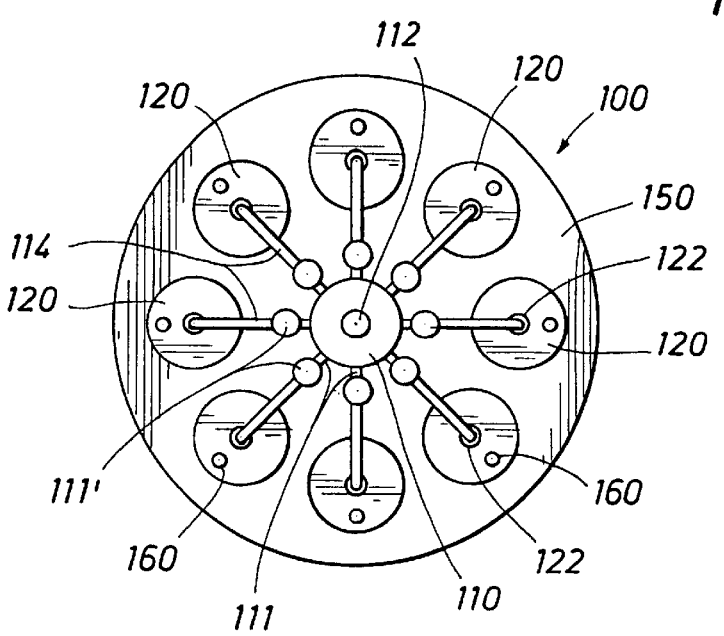
FIG. 3 is a top sectional view of a multitude, miltiphase nucleation reactor.
Figure 2:
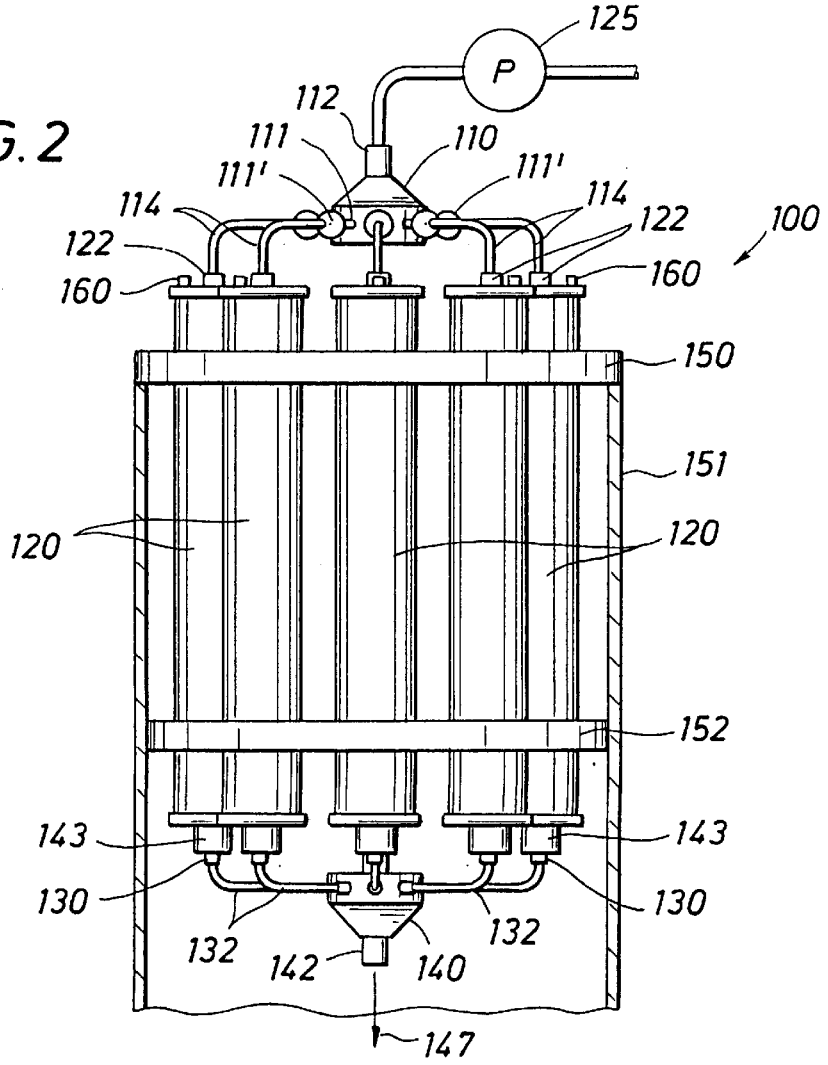

FIGS. 2 and 3 illustrates a side view and a top view, respectively, of a miltiphase, multiple tube nucleation reactor identified as a whole by the numeral 100. Multiple reactor tubes 120 are arranged in a circular fashion about a central axis, as is better shown in FIG. 3. The tubes are mechanically supported with an upper template 150 and a lower template 152, which are preferably circular in shape, and affixed to a cylindrical shroud 151. Eight tubes are shown in FIG. 3, although it should be understood that additional or fewer tubes can be used. Each tube 120 contains both water (not shown) and a heavier hydrolyzed solution (not shown). As in the single vessel reactor, the lighter water tends to "float" upon the heavier hydrolyzed solution. Cartridges are used to separate or partition the water and hydrolyzed solution as will be discussed in a subsequent section.

Again referring the FIGS. 2 and 3, water is infected, under pressure, by means of a water pump 125 to the inlet 112 of a "star burst" manifold 110. The star burst manifold has a series of outlets 111 which preferably correspond in number of the number of tubes 120, and each of which contains a valve 111'. These valves 111' are closed if the outlet 111 is not connected to an inlet 122 of a tube 120 by a flow conduit 114, or closed if one or more of the reactor tubes 120 are taken out of service for repair or maintenance. When the valves 111' are open, water flows, under pressure, into the top of each tube 120 through the corresponding inlet port 122. This pressure is transferred to the heavier hydrolyzed solution at the bottom of each tube thereby forcing the solution out of each tube 120 through a lower port 130, through connected flow conduits 132, and into a lower star burst manifold 140. Each tube 120 also contains a fill-vent port 160 with an attached valve (not shown) so that this port can be closed during normal operation of the reactor. Each port 130 also cooperates with a nucleation cartridge 143 through which the hydrolyzed solution flows. The nucleation cartridge is of the types disclosed in previously referenced U.S. Pat. No. 5,375,378 and discussed briefly above in this disclosure. As a result, a nucleated hydrolyzed solution is forced, under high pressure, into the lower star burst manifold 140 and out through an outlet port 142 (flow indicated by the arrow 147) to feed hydroblasting equipment (not showing) for purposes of abrasive cleaning as previously discussed.

Figures 2, 4A:
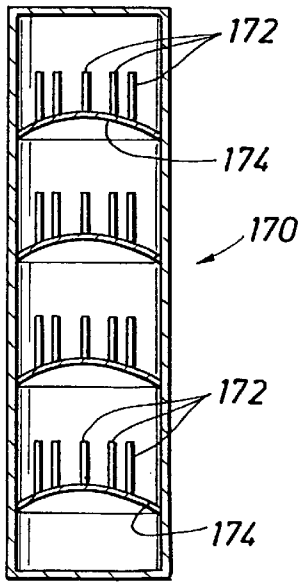
FIG. 4*a* illustrates side sectional views of mixing retardation cartridges used in the tubes of the multitude, miltiphase nucleation reactor.
Figures 1, 4B:
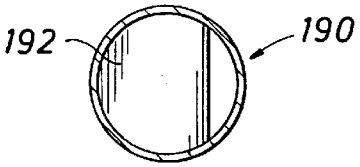
Figures 1, 4A:
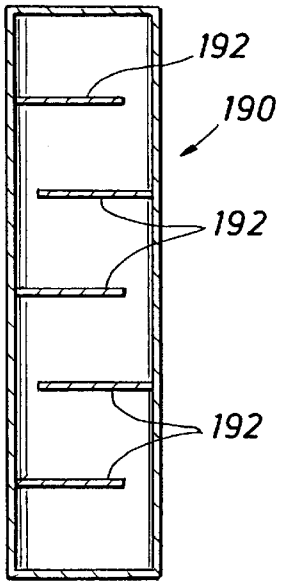

As mentioned previously, the reaction tubes 120 do not utilize a partition plate to partition the water and hydrolyzed solution phases within the reactor tubes. Alternately, solution mixing retardation tubes are inserted into the reactor tubes 120 to inhibit mixing of the water and hydrolyze(d solution phases within the reactor tubes. Side views of the cartridges arc shown in FIG. 4*a*. The first cartridge 190 contains a series of staggered baffles 192 which tend to reduce the "channeling" of the high pressure water into the hydrolyzed solution and out through the bottom ports 130. In addition, cartridges 170 comprise plates 174 and a series of capillary tubes 172 thereon. The capillary tubes retard the heavier, more viscous hydrolyzed solution from being forced upward within the reactor tube 120 due the insertion of high pressure water. The top views of the cartridges 190 and 170 shown in FIG. 4*b* illustrate more clearly some aspects of these mixing retardation cartridges.

Operating Systems

Figure 5:
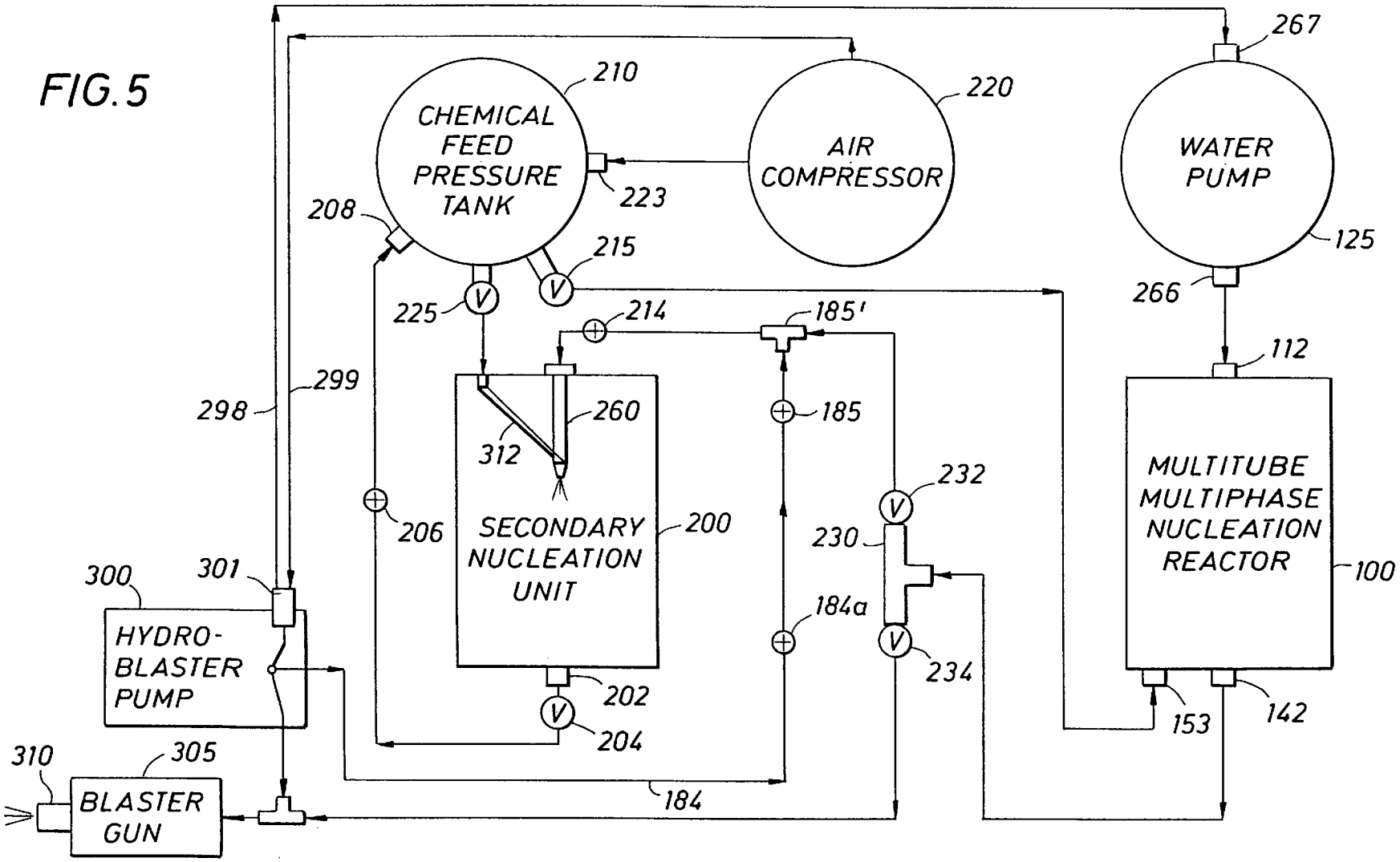
FIG. 5 shows a functional diagram of an operating hydroblasting system employing mainframe multitude, miltiphase nucleation reactor cooperating with a secondary nucleation unit.

FIG. 5 depicts a working installation of a main frame, multitude, multiphase nucleation reactor hooked up together with a repetitive nucleation reactor injector. The operation, defined as process 1, is initiated with all valves shown in FIG. 5 in the closed position. The hydroblaster 300 is started but is initially out of gear with the remaining components of the system. A valve 215 on a chemical feed pressure tank 210 is opened to fill the multitude, multiphase nucleation reactor 100. A valve 223 is then opened to pressure the chemical feed tank with air provided by an air compressor 220 thereby forcing chemical, preferably sodium silicate, from the feed tank 210, through the open valve 215, into the multitude, multiphase reactor 100 through an open valve 153. After the reactor 100 is full, the valves 215 and 153 arc closed. The air compressor 220 also supplies air pressure to operate a high pressure pump 125 through pilot switch 301 and through a line 299.

The water pump 125 shown in FIG. 5 is started by a pilot switch 301 which is activated when the hydroblaster gun 305 has its trigger pulled. Valves 266 and 112 are opened. When the hydroblaster gun 305 trigger (not shown) is pulled, it stops the gun from pumping water thus the system is pressured up to a high pressure for operating. When the system is pressured up, the pilot switch 301 is opened thus the air flow goes to the water pump 125 to operate it, through air line 298 by way of line 299 from the air compressor 220. This pressures up the system to 20,000 to 35,000 psi. Valves 142, 232 and 214 are then opened thereby teeing a second nucleation unit 200 with preferably sodium silicate passing through a nucleation tip 260. The hydroblaster 300 is then put into gear thereby putting the nucleation process in the second nucleation unit 200 and the mulitiphase, multitude nucleation unit 100 into operation. After the second nucleation unit 200 is filled preferably with nucleated sodium silicate, it is pressured into the chemical feed tank 210 by opening valves 202, 204 and 208 thereby filling the chemical feed tank 210 to start the nucleation cycle over again, but this time with prenucleated chemical which is preferably prenucleated sodium silicate. A check valve 206 prevents flow from the chemical feed tank 210 back into the secondary nucleation unit 200. The second nucleation process in the second nucleation unit 200 is controlled by the setting of the valve 214.

A high pressure water line 184 from the hydroblaster 300 to the tee 185' furnishes high pressure water for secondary nucleation in the unit 200. A check valve 184*a* prevents flow from the tee 185' back to the hydroblaster 300.

During the nucleation processes, a blaster gun 305 can be simultaneously put into operation by opening valve 234 which allows nucleated material to flow through the tee fitting 230 directly to the gun 305.

Still referring to FIG. 5, the multitude, multiphase reactor 100 can be used separately from the second nucleation unit 200. To do this, valve 232 is closed, and valve 225 is opened to feed a venturi nucleation tip combination inlet 312 into the unit 200. The valves 202 and 204 are opened to recirculate the nucleated sodium silicate back to the feed tank 210 where it again call be recirculated back through the nucleation process, or can be pressured into the multitude, multiphase nucleation reactor to be pressured into the blaster gun. Pressure needed to operate in this mode is controlled by the valve 214 thereby controlling blaster pressure. The pressure to do this is furnished through line 184 coming from the blaster 300 and going through tee 185 and eventually through tip 260 which is a combination of venturi tube 312 and nucleation blaster tip, which again nucleates the product coming from chemical tank 210 repeatedly as the product recirculate through the venturi tube 312. While all of this repetitive nucleation is going on in the secondary nucleation unit 200, the multitude, multiphase nucleation reactor 100 can be operated by having valve 232 closed and valves 234 and 142 in the reactor 100 opened to inject into the blaster 305. The water pump 125 is put into operation by opening air valve 267 and liquid flow valves 266 and 112.

Figure 6:
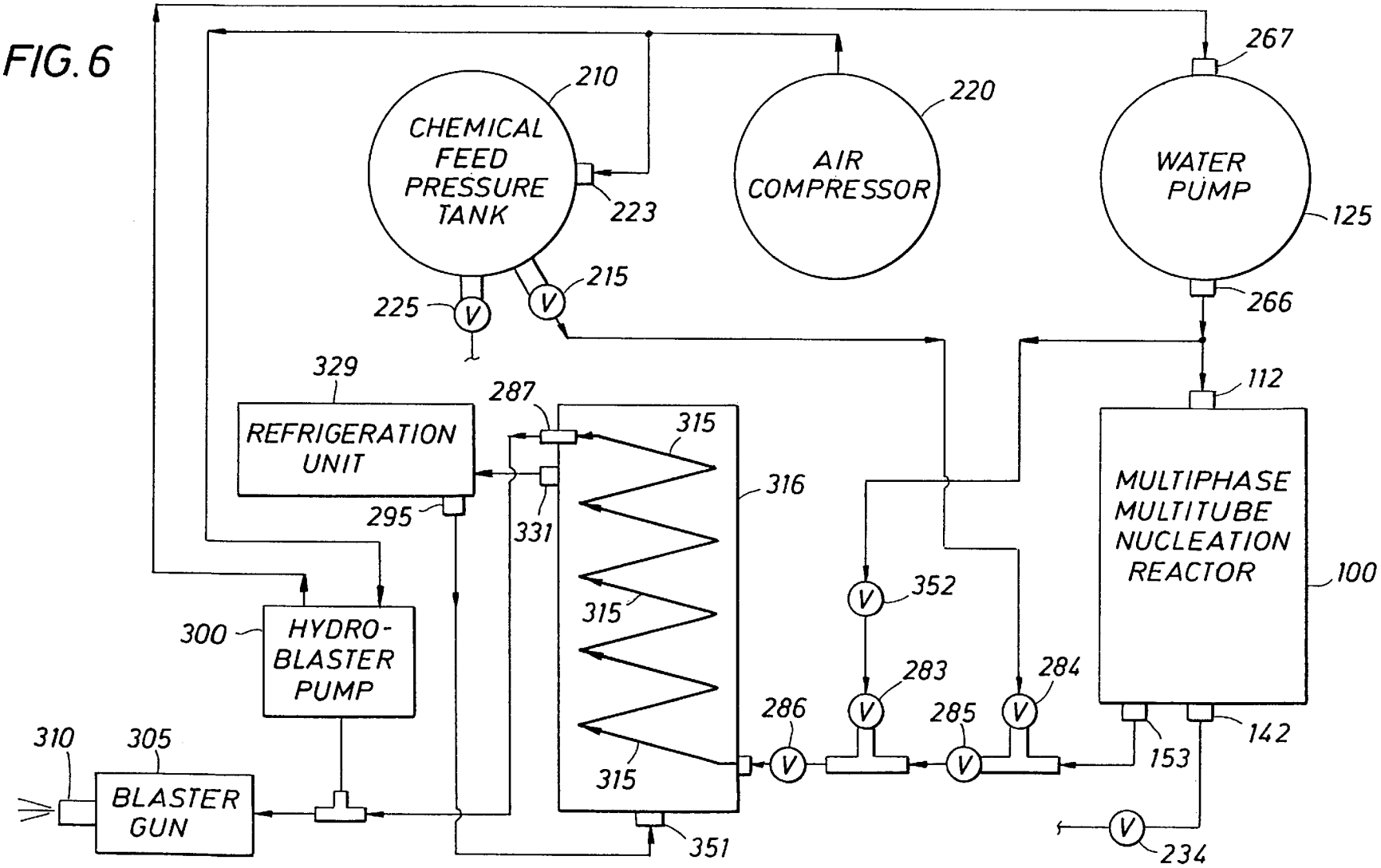
FIG. 6 shows a functional diagram of an operating hydroblasting system employing a mainframe multitude, miltiphase nucleation reactor cooperating with a thermal control chamber.

A thermal control chamber can be used to control thermal assisted electrolyte catalyzing nucleation. FIG. 6 depicts an alternate working installation of a mainframe multitude, multiphase nucleation reactor 100 hooked up to a thermal control chamber 316.

This process of nucleation, referred to as process II, actually comprises two sub processes as will be discussed in detail.

The first sub process using the system of FIG. 6, defined as process IIA, utilizes the temperature control chamber 316 only if the nucleation temperature can not be controlled by other means. If temperature control is not required, the solution to be nucleated simply flows through coils 315 within the chamber 316, and through nucleation cartridges 287 and 310. The control of telpelature in the nucleation process is of great importance in that temperature control of the product prevents retardation in nucleation. This process is discussed in the previously cited Zettlemeyer reference. The second sub process, defined as process IIB, utilizes the mainframe multitude, multiphase nucleation reactor 100 working together with the temperature control chamber 316 to nucleate the desired solution. The operation of the system shown in FIG. 6 for each process will be discussed in detail.

Process IIA

In process IIA, only the thermal control chamber 116 is used to control a thermal assisted electrolyte catalyzing nucleation process, and is operated alone to nucleate. In process IIA, all valves are initially closed. Hydroblaster 300 is started but is out of gear. Air pressure pump 220 is then started to pressurize the chemical feed tank 210 through open valve 223. Valves 215. 284 285 and 286 are then opened thereby filling coils 315 in the thermal control chamber 316 with chemicals from the feed tank 210. After the coils 315 are filled with preferably sodium silicate the valve 285 is closed. High pressure water pump 125 is now turned on thereby forcing the preferably sodium silicate through the nucleation coils 315, and through a nucleation cartridge outlet 287. and eventually out through nucleation tip 310 of blaster gull 305. A check valve 352 prevents water or any chemical solution from flowing, back into the water pump 125. After nucleated sodium silicate is put out valve 287 into the blaster gun 305, the hydroblaster 300 is put into gear and powered up. Refrigeration or cooling processor 329 is now started and valve 295 is opened. Liquid refrigerant is circulated into the chamber 316 through an inlet 351, and out of this chamber through outlet 331 and back to the refrigeration unit 329. The refrigerant flows upwardly through the chamber 316 thereby controlling the temperature of the solution flowing within th coils 315, and thereby controlling the nucleation process of this solutioin.

Process IIB

As mentioned previously, the nucleation system shown in FIG. 6 can be used in another nucleation process, defined as process IIB. The process is initiated with all valves initially closed. Again, the hydroblaster 300 is started but is out of gear. Valve 215 on the chemical feed tank 210, as well as valves 286, 284, 285 and 153 are opened thereby filling both the mainframe multitude, multiphase nucleation reactor 100 and the coils 315 of the thermal control chamber 316 with chemical solution which is preferably sodium silicate. After the coils 315 and the mainframe multitude, multiphase nucleation reactor 100 are tilled, the valve 284 is closed. The water pump 125 is then started ant the valve 121 is opened thereby pressuring up the mainframe multitude, multiphase nucleation reactor 100 and the thermal control chamber 316. Chemical solution then flows out through the nucleation cartridge outlet 287 into the blaster gun 305. The hydroblaster 300 is now put into ,ear and powered up. The previously discussed refrigeration process 329 is now initiated, valve 295, is opened and liquid refrigerant is circulated into the chamber 316 through th inlet port 351, and out though the outlet port 331 hack to the refrigeration unit 329 thereby controlling temperature of the chemical flowing within the coils 315.

Examples of Hydrolyzed Solutions

Sodium silicate is the preferred hydrolyze solution, Potassium silicate can be used in combination with, or as an alternate to, sodium silicate. Potassium is more water soluble than sodium silicate which is advantageous in using the present invention. Potassium silicate is, however, much more expensive than sodium silicate. Weighing the technical, operational and financial factors involved, sodium silicate is considered the preferred hydrolyzed solution for the present invention.

The following is an example of a hydrolyzed solution of a hydrolyzed solution of sodium silicate.

The following are added to 30 gallons of water and mixed:

(1) solid sodium silicate (crystalline solids, $NaSiO_3$, and $NaSi_4$) in the amount of approximately 1.0–5.0 wt. % of the water used (2) Approximately 2 to 3 gallons of 40° to 42° sodium silicate solution (3) 5% acetic acid or 5% citric acid is added to lower the pH of the combines solution to approximately 7.0 to 7.3.

This mixture performs well for cutting and cleaning hardened plastics, steels and stainless steels. Other examples of mixtures, and the cleansing tasks for which they are optimally designed, are disclosed in the previously referenced U.S. Pat. No. 5,375,378.

Summary

This disclosure illustrates the stated objects of the invention, and additional objects and applications. More particularly, the previous description of apparatus and methods of the invention serve to illustrate the versatility of the invention in performing many cleaning tasks economically from an operational and materials viewpoint. There are other embodiments and applications of the invention which will be apparent to practitioners of the art.

While the foregoing is directed to the preferred embodiments the scope thereof is determined by the claims which follow.

What is claimed is:

1. An apparatus for making fluid for hydroblast cleaning, comprising:

(a) a reactor vessel comprising an input port and an output port;

(b) means for supplying water under pressure to said input port;

(c) means for inserting a hydrolyzed solution into said reactor vessel;

(d) means for partitioning said water from said hydrolyzed solution within said reactor vessel; and (e) a nucleation cartridge positioned at or near said output port, wherein said water under pressure forces said hydrolyzed solution through said nucleation cartridge thereby forming said hydroblasting cleaning fluid containing abrasive crystals.

2. The apparatus of claim 1 wherein said water under pressure is flowed to said reactor vessel input port by means of a high pressure pump.

3. The apparatus of claim 1 further comprising a flow conduit through which said cleaning fluid containing abrasive particles flows from said reactor vessel output port to a hydroblast gun.

4. The apparatus of claim 1 wherein said hydrolyzed solution is partitioned from said water by means of a plate which move with changing volume of said hydrolyzed solution within said reactor vessel.

5. The apparatus of claim 4 wherein said nucleation cartridge comprises planes and fins which induce nucleation of abrasive particles within said hydrolyzed solution as said solution flows through said cartridge.

6. The apparatus of claim 1 further comprising;

(a) one or more additional reactor vessels thereby forming a plurality of reactor vessels, wherein each said reactor comprises
  (i) an input port and an output port, and
  (ii) a nucleation cartridge within or near said output port, and wherein
  (iii) each reactor contains said hydrolyzed solution;

(b) an input manifold which connects said input ports to said supply of water under pressure; and (c) an output manifold which connects each said output port to a first end of a common output flow conduit, wherein (d) said water under pressure forces said hydrolyzed solution through each said nucleation cartridge thereby forming said hydroblasting cleaning fluid which contains abrasive crystals, and wherein (e) said hydroblasting cleaning fluid flows into said common output flow conduit.

7. The apparatus of claim 6 wherein said hydrolyzed solution is partitioned from said water within each said reactor vessel by means of retardation tubes.

8. The apparatus of claim 6 wherein a second end of said common flow conduit is attached to a hydroblasting gun.

9. A nucleation reactor injector apparatus for a hydroblasting cleaning system, comprising:

(a) a reactor vessel with an input port and an output port;

(b) means for supplying water under pressure to said input port;

(c) means for inserting hydrolyzed solution into said reactor vessel;

(d) a catalytic impact tube cartridge positioned within said output port; and (e) a partition plate within said reactor vessel which partitions said water and said hydrolyzed solution within said reactor, wherein (f) said water under pressure forces said hydrolyzed solution through said catalytic impact tube cartridge thereby forming said hydroblasting cleaning fluid contains abrasive crystals.

10. The apparatus of claim 9 wherein said hydrolyzed solution comprises sodium silicate and water, with the amount of sodium silicate approximately 1 to 5 weight percent of the water used.

11. The apparatus of claim 10 further compromising a water pump which supplies water to said input port at about 20,000 psi, thereby:

(a) supplying pressure required to from said abrasive crystals within said cleaning fluid, and (b) supplying pressure to deliver said cleaning fluid to hydroblasting equipment.

12. The apparatus of claim 10 wherein the density of said hydrolyzed solution is greater than the density of water, and said partition plate is ballasted to float upon said hydrolyzed solution.

13. The apparatus of claim 10 further comprising flow conduit through which said hydroblasting cleaning fluid flows, wherein:

(a) a first end of said flow conduit is connected to said output port;

(b ) a second end of said flow conduit is connected to a hydroblaster gun; and (c) said flow conduit contains a fragmented glass catalytic impact cartridge which further induces nucleation within said hydroblasting cleaning fluid flowing there through.

14. The apparatus of claim 13 comprising a catalytic fin impact tube which is positioned within said flow conduit and which further induces nucleation within said cleaning fluid flowing there through.

15. A multiple tube nucleation reactor injector apparatus for a hydroblasting cleaning system, comprising;

(a) a plurality of reactor tubes, wherein each lube comprises
  (i) an input port and all output port, and
  (ii) a primary nucleation unit within or near said output port, and wherein
  (iii) each reactor contains a hydrolyzed solution;

(b) an input manifold which connects said input ports to a source of high pressure water; and (c) an output manifold which connects each said output port to a first end of a common output flow conduit, wherein (d) said water under pressure forces said hydrolyzed solution through each said nucleation cartridge thereby forming said hydroblasting cleaning fluid containing abrasive crystals, and wherein (e) said hydroblasting cleaning fluid flows into said common output flow conduit.

16. The apparatus of claim 15 further comprising:

(a) a secondary nucleation unit comprising a venturi nucleation tip which cooperates with a tee connector and a valve in said common output flow conduit to receive nucleated cleaning fluid from said multiple tube nucleation reactor injector thereby further nucleating said cleaning fluid;

(b) a chemical pressure feed tank which supplies hydrolyzed solution to said multiple tube nucleation reactor injector and said secondary unit; and (c) means for returning cleaning fluid output from said secondary unit, through said chemical pressure feed tank, to said multiple tube nucleation reactor injector for further nucleation of said cleaning fluid.

17. The apparatus of claim 15 wherein said hydrolyzed solution is partitioned from said water within each said reactor tube by means of retardation tubes, wherein each retardation tube comprises:

(a) a series of baffle plates which reduce the channeling of said water under pressure into said hydrolyzed solution; and (b) series of capillary tubes which retard heavier, more viscous hydrolyzed solution from flowing into said water.

18. The apparatus of claim 17 wherein a second end of said common output flow conduit is attached to a hydroblasting gun, wherein said hydroblasting gun comprises a nucleation tip which further nucleates said cleaning fluid upon ejection from said hydroblasting gun.

19. The apparatus of claim 15 further comprising a water pump which delivers water to said input manifold at pressures between 20,000 and 35,000 psi.

20. The apparatus of claim 16 further comprising means for controlling the temperature of said hydrolyzed solution in the primary nucleation unit.

* * * * *